United States Patent [19]

Frantz

[11] Patent Number: 4,789,346

[45] Date of Patent: Dec. 6, 1988

[54] SOLDER POST ALIGNMENT AND RETENTION SYSTEM

[75] Inventor: Robert H. Frantz, Newville, Pa.

[73] Assignee: AMP Incorporated, Harrisburg, Pa.

[21] Appl. No.: 31,483

[22] Filed: Mar. 27, 1987

[51] Int. Cl.[4] ..... H01R 9/09

[52] U.S. Cl. ..... 439/80; 439/599; 439/876

[58] Field of Search ..... 439/78–80, 439/83, 598, 599, 634, 629, 636, 637, 876

[56] References Cited

U.S. PATENT DOCUMENTS

| | | | |
|---|---|---|---|
| 3,493,916 | 3/1970 | Hansen | 339/17 |
| 3,551,877 | 12/1970 | Telmosse et al. | 339/156 |
| 3,601,762 | 8/1971 | Eshelman | 339/64 |
| 3,864,000 | 2/1975 | Coller et al. | 339/64 |
| 3,905,673 | 9/1975 | Evans et al. | 339/192 |
| 4,080,041 | 3/1978 | Hawkins, Jr. | 339/196 M |
| 4,186,988 | 2/1980 | Kobler | 339/176 |
| 4,210,376 | 7/1980 | Hughes et al. | 339/17 LC |
| 4,225,209 | 9/1980 | Hughes | 339/126 R |
| 4,410,230 | 10/1983 | San Miguel | 439/876 |
| 4,491,376 | 1/1985 | Gladd et al. | 339/9 E |
| 4,641,908 | 2/1987 | Steffinger | 438/599 |
| 4,655,518 | 4/1987 | Johnson et al. | 439/80 |

FOREIGN PATENT DOCUMENTS 0103949 12/1983 European Pat. Off. .

1240190 10/1959 France .

5916150 3/1986 Japan .

OTHER PUBLICATIONS

EPO Standard Search Report DTD, 1/13/88.

EPO STD Search Report Annex.

U.S. application Ser. No. 876,970 filed Jun. 19, 1986.

*Primary Examiner*—Gil Weidenfeld

*Assistant Examiner*—Paula A. Austin

*Attorney, Agent, or Firm*—David L. Smith

[57] ABSTRACT

A right angle connector assembly (20) has a plurality of rows of contact receiving passages (36) laterally aligned with parallel profiled channels (112, 114) in a solder post spacer plate (46). Contacts (38) having a mating portion (40) and a mounting portion (42), typically a solder post (44), are inserted into all of the contact receiving passages (36) in a row simultaneously. Concurrent therewith, the solder posts (44) thereof are inserted into alternate profiled channels (112, 114) in the solder post spacer plate (46). As the solder posts (44) are inserted into the channels (112, 114) the portion (122, 124) of the post spacer plate (46) between adjacent channels (112, 114) deflect laterally with a different effective beam length (126, 154, 170) for each row of contacts (38) inserted. Contacts (38) seat in detents (148, 162 and 130) in channels (112, 114).

21 Claims, 5 Drawing Sheets

SOLDER POST ALIGNMENT AND RETENTION SYSTEM

BACKGROUND OF THE INVENTION

The present invention relates to electrical connectors and in particular to a solder post alignment and retention system for right angle mounted connectors.

Right angle connectors are typically mounted on a printed circuit board. A complementary connector mates with the right angle connector in a direction parallel to the printed circuit board. Contacts in the right angle connector have a mating portion that is parallel to the printed circuit board and a mounting portion that is in electrical contact with circuits on the printed circuit board, with the mounting portion, typically a solder tail, extending from the mating face of the connector substantially at a right angle to the mating portion of the contact. Solder tails typically extend through plated through holes in the printed circuit board and are soldered. The array of printed circuit board through holes have the same pattern and spacing as the solder tails extending from the mating face of the connector.

Various approaches have been taken to maintain the solder tails in the predetermined array configuration. One approach has been to make the connector housing in multiple parts, one of which is a locator plate having an array of apertures corresponding to the pattern and spacing of solder tails extending from the mating face of the connector. After all of the contacts are inserted into the connector housing, the locator plate is passed over the solder tails from the ends thereof and o secured to the connector housing. U.S. Pat. No. 4,080,041 is typical of this approach.

Other approaches use slotted locator plates. With the contacts inserted into contact receiving passages in a connector, the solder tails are bent into the slots of the locator plate to form a right angle with respect to the mating portion of the contacts. U.S. Pat. No. 4,210,376 discloses a right angle connector in which conductors adjacent their lower ends are provided with retaining lances. The lances are received in recesses in the sidewalls of the channels to retain the conductors in the channels. When drawn wire conductors are used alternately deep and shallow channels may be used. The channels have extremely narrow entrance portions and enlarged inner ends. The inner ends should be dimensional to accommodate the wire conductors and the narrow entrance portion should have a width such that the conductors must be forced into the channels.

U.S. Pat. No. 3,493,916 discloses a right angle connector having a plurality of terminals which have a rearward end portion extending through either a first series of relatively long slots or a second series of relatively short slots in a rearwardly extending flange portion of the connector.

U.S. Pat. No. 4,491,376 issued to Gladd et al. employs a slotted locator plate in which the slots are narrower in width than the solder tails. Each slot is aligned vertically with a contact receiving passage in both rows of contact receiving passages. Each slot has two detents formed by recesses in the otherwise parallel walls of the locator plate slots. The lower row of solder tails is bent about an anvil and forced into the forward detents in the locator plate slots. Subsequently, the upper row of solder tails is bent and forced into the rear detents in the locator plate and forced into the rear detents in the locator plate slots. Gladd et al. do not teach whether all of the tails of one row are bent simultaneously or whether the tails are bent individually or otherwise. Since the tails are wider than the slots it would be difficult if not impossible to simultaneously bend all tails in a row and insert them in respective locator plate. Furthermore there is no teaching of the cross section of the detents relative to the cross section of the tails.

U.S. Pat. No. 4,225,209 discloses a right angle connector in which conductors are received in spaced apart channels with alternate channels being relatively deep. The sidewalls of the channels are provided with depressions or recesses which receive barbs integral with and extending laterally from the side edges of the conductors. The intermediate portions of the conductors which extend from apertures to the channels are thus held rigidly by the barbs in the channels and by the conductors received in the apertures.

U.S. application Ser. No. 876,970 filed June 19, 1986 discloses a right angle connector having three rows of contacts. The contacts are inserted into contact receiving passages in the connector housing. The contact receiving passages open into channels axially aligned therewith on mandrels with a mandrel associated with each row of contacts. The contacts are bent over the mandrels forming a right-angled bend and passed into slots in a contact locating plate beneath the mandrels with the slots in line with the contacts. The upper and lower rows of contacts are laterally aligned with each other and with a first contact receiving slot. The first slot has two widths with a rib on each wall forming the slot extending into the slot along the length thereof. When the contacts are positioned in the slot, the ribs secure the contact at the desired position by an interference fit. The middle row of contacts is aligned with a second contact receiving slot having ribs on each wall which secure contacts positioned therein at the desired position by an interference fit.

SUMMARY OF THE INVENTION

In accordance with the invention, a right angle connector assembly having a plurality of rows of contact receiving passages therein has a solder post spacer plate having a plurality of parallel profiled channels laterally aligned with the contact receiving passages. Contacts are inserted into all of the contact receiving passages in a row simultaneously. As the mating portion of the contact is inserted into a respective contact receiving passage, the mounting portion of the contact, typically a solder post, is inserted into a laterally aligned profiled channel until seated in a detent corresponding to the contact receiving passage. Solder posts from one row of contacts seat in spaced apart channels while solder tails from an adjacent row of contacts seat in spaced apart alternate channels. The solder post spacer plate between adjacent channels forms beams that deflect laterally during insertion of solder posts in the channels. The channels vary in width with some regions narrower than the width of the solder posts inserted therein. The beams deflect in a first direction during insertion of solder posts in alternate channels and deflect in a second, opposite direction during insertion of solder posts in adjacent alternate channels. The solder posts seat in respective detents in an interference fit that prevents lateral movement of the solder tail. As each row of contacts is inserted, the effective beam length shortens as the solder post spacer plate having contact solder posts secured in channel detents becomes a rigid body.

DESCRIPTION OF THE PREFERRED EMBODIMENT

Figure 1:
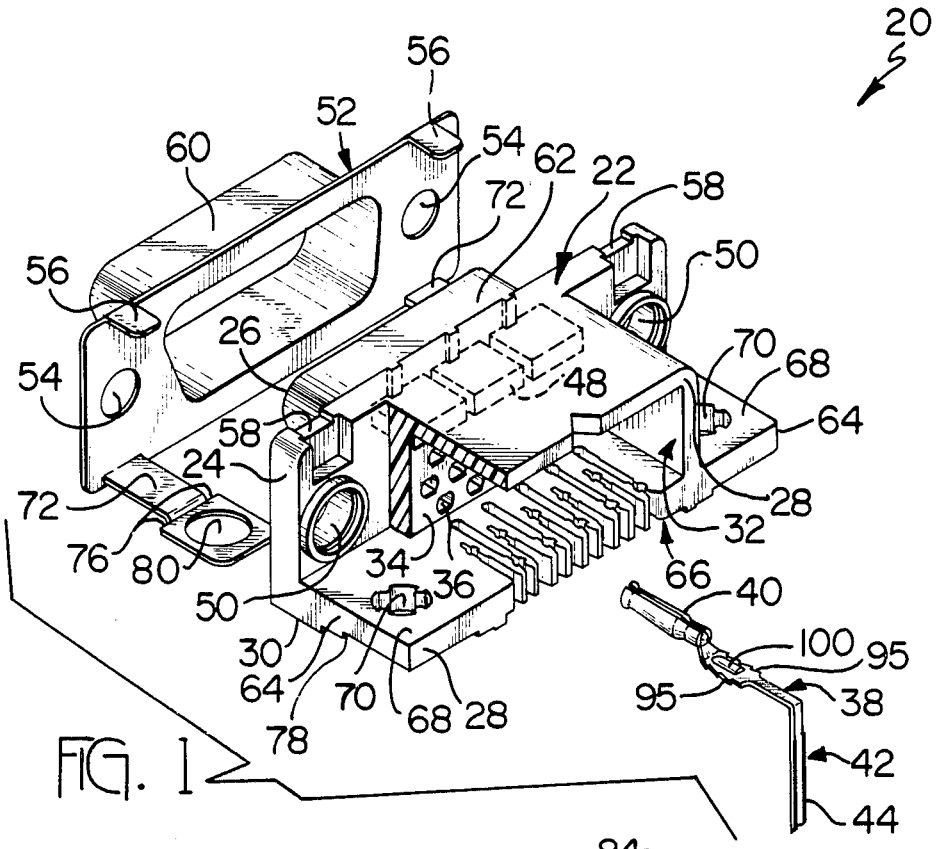
FIG. 1 is a top perspective view of a connector incorporating the profiled channel locator plate of the present invention with a shell exploded therefrom.

Referring to the Drawing, initially to FIG. 1, there is depicted therein a perspective view of an electrical connector assembly 20 in accordance with the present invention. The connector assembly 20 shown is exemplary and is one of a well known type, namely a subminiature D connector of the type manufactured by the assignee, AMP Incorporated, and sold under the trademark AMPLIMITE.

Connector 20 comprises housing 22 molded of thermoplastic with integral peripheral flange 24, mating face 26, opposed rear face 28 and mounting face 30 at a right angle with respect to mating face 26. Cavity 32 is recessed from rear face 28 and defines recessed face 34. A plurality of contact receiving passages 36 extend from mating face 26 rearward toward rear face 28, open to recessed face 34 and have contacts 38 secured therein. Recessed face 34 is not limited to being planar but could, for example, be stepped. Contacts 38 have a mating portion 40 extending into contact receiving passages 36 that may be either pins or sockets and extend into cavity 32 with mounting portions 42, typically solder posts 44, that extend through post spacer plate 46. In the preferred embodiment, housing 22 is molded in a single piece with post spacer plate 46 integral therewith. Housing 22 also has apertures 48 for removal of vapor phase material. Mating face 26 is surrounded by flange 24 having mounting apertures 50 at opposite ends thereof for securing a complementary connector (not show) thereto.

Electrically conductive shell 52 has a similar outer profile to flange 24 with shell mounting apertures 54 aligned with apertures 50. Lugs 56 on the upper portion of shell 52 fold into recesses 58 on flange 24 to secure shell 52 to housing 22. Shroud 60 extends upward from the flat portion of shell 52 and conforms to and encloses the forward raised portion 62 of housing 22.

Mounting face 30 of connector assembly 20 has integral flanges 64 at opposite ends thereof. Each flange 64 has a coplanar mounting face 30 which is received against a printed circuit board (not shown) with channels 66 provided for flux removal, an opposed holding face 68 with aperture 70 extending therebetween.

Shell 52 has integral ground straps 72 extending to respective mounting faces 30. Ground straps 72 fold into channel 74 such that the lower surface of ground strap is coplanar with mounting face 30 and widens near rear face 28 forming shoulders 76 that engage stops 78 to aid in securing ground strap 72 to housing 22 during unmating of a complementary connector. Apertures B0 in the widened region of ground strap 72 align with apertures 70 in flange 64.

Contacts 38 are formed in a strip on the desired centerline spacing such as in accordance with the teaching of application Ser. No. 012,100 filed Feb. 6, 1987, said application being hereby incorporated by reference. During fabrication of a connector assembly 20, contacts 38 on a common carrier strip 82 are unwound from a reel (not shown).

A length of carrier strip 82 called a "comb" having the number of contacts 38 conforming to the number of contact receiving passages 36 in a row of housing 22 is severed from the reel. The solder posts 44 of the contacts 38 on the comb of severed carrier strip 82 are formed to be substantially perpendicular to the mating portion 40 of contacts 38.

Loading block 84 is inserted into cavity 32 seating on recessed face 34. Loading block 84 has a plurality of channels 86 aligned with and corresponding in number to contact receiving passages 36 in the row of passages 36 into which contacts 38 will be inserted. Channels 86 thus provide an extension of contact receiving cavity 36 toward or beyond rear face 28. Channels 86 in loading block 84 open to surface 88 of block 84 through slots 91. The row of contact receiving passages 36 closest to post spacer plate 46 is typically the first to receive contacts 38, then the next closest row of contact receiving passages 36 and so on. A different loading block 84 is used for each row of passages 36 with channels 86 therein aligned with passages 36.

Contacts 38, bent 90 degrees and still integral with carrier strip 82 are partially inserted into respective channels 86 in loading block 84. Contacts 36 are loose pieced by shearing carrier strip 82 between punch 90 and anvil 92 then inserted to a predetermined depth in passages 36 by passing through respective channels 86 in loading block 84 thence into passages 36.

Figure 7:
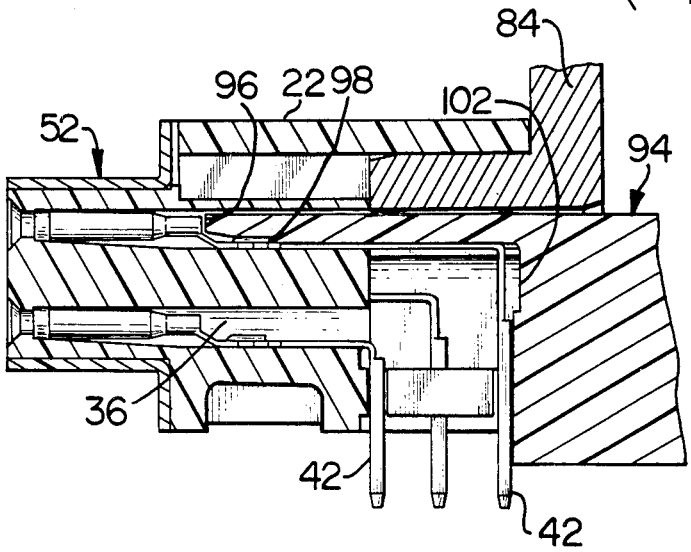
FIG. 7 is a side view, partially in section of a connector and insertion tool.
Figure 2:
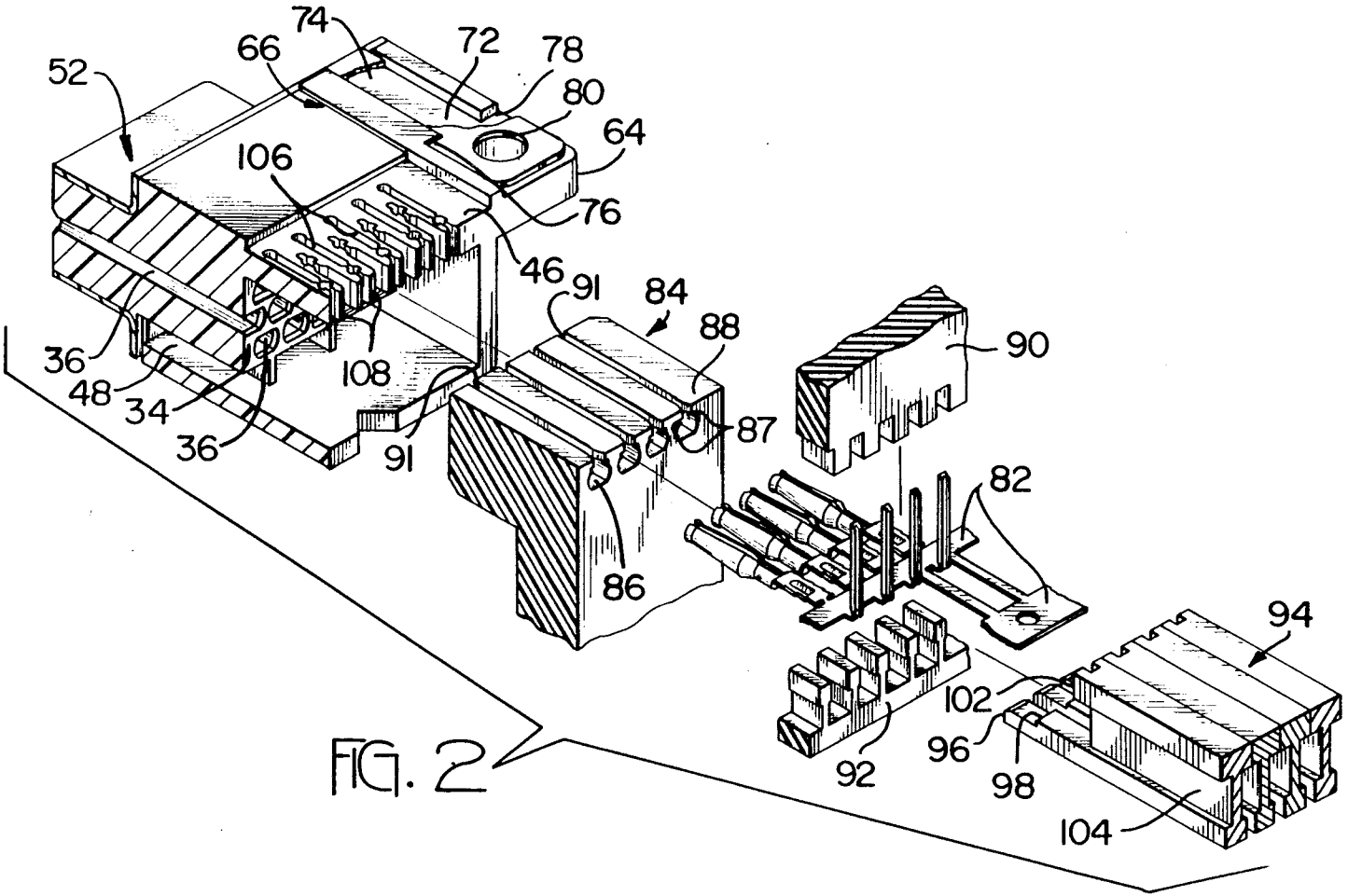
FIG. 2 is a bottom exploded perspective view of a connector incorporating the solder post retention system of the present invention at one stage during assembly.

Insertion tool 94 provides the insertion force to insert contacts 38 into housing 22. As seen in FIG. 7, mating portion push surface 96 engages the rear surface of mating portion 40, insertion feature push surface 98 engages insertion feature 100 and solder post push feature 102 engages substantially the length of solder post 44.

As insertion tool 94 pushes contacts 38 through channels 86, barbs 95 for securing contact 38 in contact receiving passage 38 in an interference fit pass through side channels 87 and solder posts 44 extend through slots 91 and post spacer plate 46. At least a portion 104 of insertion tool 94 passes through slot 91 and channels 106 in post spacer plate 46.

Figure 3:
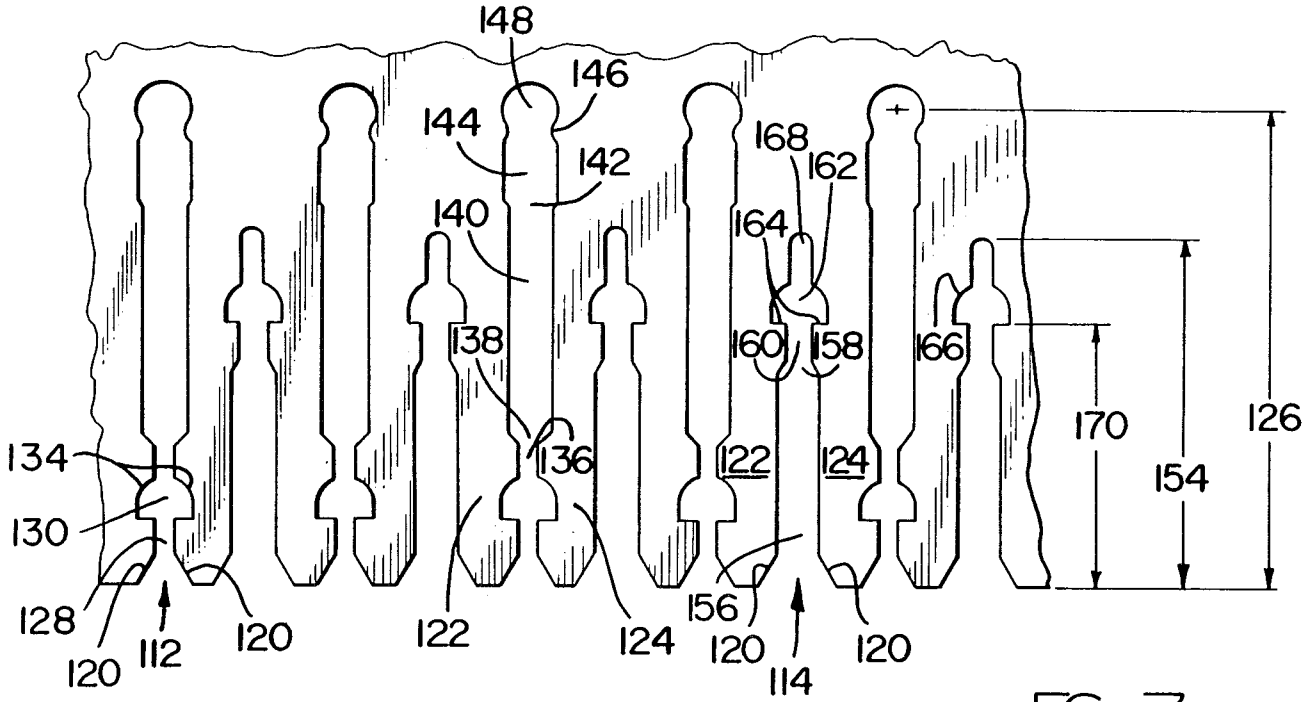
FIG. 3 is a plan view of the post spacer plate of the present invention for a connector with three rows of contacts.

FIG. 3 shows a bottom plan view of a post spacer plate 46 broken away from housing 22 for a connector assembly 20 having three rows of contacts 38 and correspondingly three rows of contact receiving passages 36. For reference, the row of contact receiving passages 36 and contacts 38 closest to post spacer plate 46 is referred to as the lower row. The row of contacts receiving passages 36 and contacts 38 most distant from post spacer plate 46 is referred to as the upper row. The row of contact receiving passages 36 and contacts 38 between the upper and lower rows is referred to as the middle row. Contacts 38 in each row are identical but for the length.

Post spacer plate 46 is an integral part of housing 22 and extends rearward from contact receiving passages 36 to rear edge 108 which may be flush with rear face 28. Post spacer plate 46 has a plurality of channels 112, 114 extending forwardly from rear edge 108 and opening thereon. Solder posts 44 from contacts 38 in the upper and lower rows of contact receiving passages 36 pass into and are secured in alternate channels denoted 112. Solder posts from contacts 38 in the middle row of contact receiving passages 36 are secured in adjacent alternate channels denoted 114.

Solder posts 44 from the lower row of contacts 38 are secured in channels 112 first. Solder posts 44 have a U-shaped cross section and are inserted into channels 112 with arcuate convex outer surface 116 leading and insertion tool 94 engaging inter alia arcuate concave inner surface 118. As solder posts 44 engage tapered lead in surfaces 120, the solder post spacer plate 46 between channel 112 and an adjacent channel 114 form beams 122 and 124 that bias or deflect laterally with an effective beam length 126.

After passing between tapered lead in surfaces 120, solder posts 44 enter a first region 128 of channel 112 having substantially parallel walls. First region 128 is narrower in width than the uncompressed cross section width of solder posts 44. There is some lateral compression of solder posts 44 in first region 128. Solder posts 44 next enter detent 130 with beams 122 and 124 returning toward their undeflected or unbiased position. Solder posts 44 having a leading arcuate convex outer surface 116 that engages arcuate surfaces 134 in detent 130 again laterally deflects beams 122 and 124 which still have an effective beam length 126 and enters a second region 136 having substantially parallel walls. Second region 136 is narrower in width than the uncompressed cross section width of solder posts 44.

Solder posts 44 then pass through a first transition region 138 in channel 112, that widens in the direction of insertion of solder posts 44, and into a third region 140 of channel 112 having substantially parallel walls. Third region 140 is narrower in width than the uncompressed cross section width of solder posts 44.

Solder posts 44 then pass through a second transition region 142, that widens in the direction of insertion of solder posts 44, with channel 112 widening to substantially the width of an uncompressed solder post 44 in fourth region 144. Thus, as solder posts 44 recover from a compressed condition. Fourth region 44 extends from the end of channel 114 to neck 146, has substantially parallel walls and provides for free movement of solder posts 44 therealong.

Figure 4:
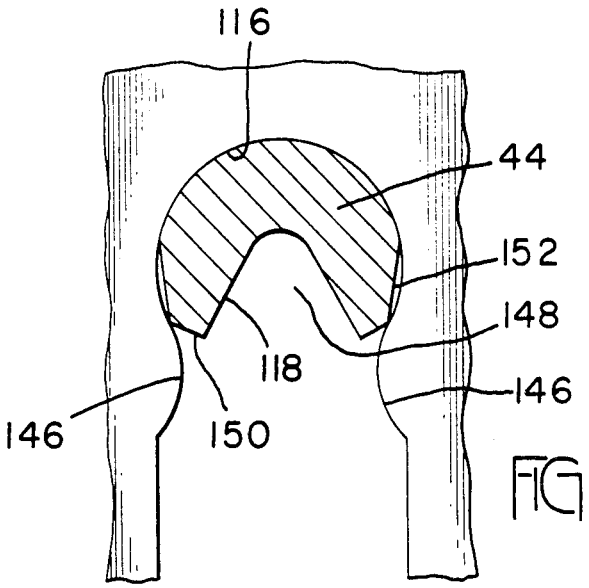
FIG. 4 is a partial plan view, partially in section, showing a cross section of a solder post seated in a detent to prevent the solder post form moving laterally.

Solder posts 44 then pass through restricting neck 146 to seat in detent 148 as shown in greater detail in FIG. 4. Detent 148 opens to neck 146, is substantially circular, slightly smaller in diameter than the cross section of an uncompressed solder post 44 and receives solder post 44 in an interference fit. Beams 122 and 124 return to their unbiased position. In a preferred embodiment solder posts 44 have a U-shaped cross section having an arcuate convex outer surface 116, an arcuate concave inner surface 118 and planar surfaces 150, 152 extending therebetween at two locations. Surfaces 116, 150 and 152 provide an interference fit with detent 148 thereby securing solder posts 44 in detents 148. Loading block 84 is removed from cavity 32.

Solder posts 44 from the middle row of contacts 38 are then secured in channels 114. A loading block 84 having channels 86 aligned with contact receiving passages 36 in the middle row is positioned in cavity 32. As contacts 38 are inserted, solder posts 44 engage tapered lead in surfaces 120. Beams 122 and 124 deflect laterally with an effective beam length 154 that is the length of channel 114. After passing between tapered lead in surfaces 120, solder posts 44 enter a first region 156 of channel 114 having substantially parallel walls. First region 156 is narrower in width than the uncompressed cross section width of solder posts 44 and is substantially the width of third region 140 in channel 112 with beams 122 and 124 undeflected or unbiased.

Solder posts 44 then pass though a first transition region 158 in channel 114 which narrows in the direction of insertion of solder posts 44. As solder posts 44 pass through first transition region 158, beams 122 and 124 further deflect laterally and solder posts 44 are subjected to further compression.

Solder posts 44 then pass through second region 160 in channel 114. Second region 160 has substantially parallel walls and with beams 122 and 124 undeflected is substantially the width of first region 128 and second region 136 in channel 112.

Figure 5:
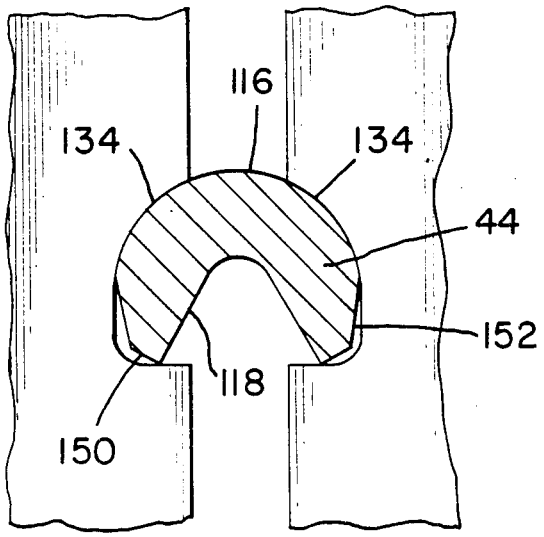
FIG. 5 is a partial plan view, partially in section, showing a cross section of a solder post seated in a detent to prevent the solder post from moving laterally.

Solder posts 44 then pass into and seat in detent 162 as shown in greater detail in FIG. 5. Detent 162 is formed in the walls of channel 114 as shoulder 164 and arcuate surface 166 which substantially conforms to the curvature of arcuate convex outer surface 116 of solder posts 44.

Figure 6:
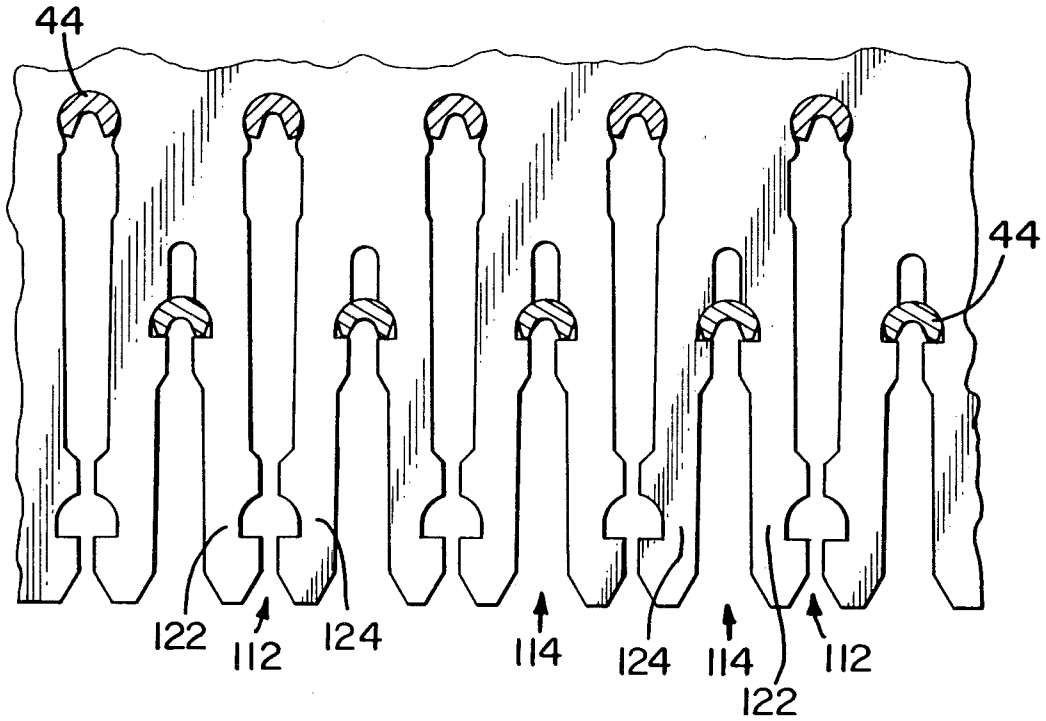
FIG. 6 is a plan view, partially in section, of the post spacer plate of the present invention with two rows of contacts inserted therein.

Beams 122 and 124 return toward their unbiased position. Since the uncompressed cross section width of solder posts 44 exceeds the width of detent 162 with beams 122 and 124 in an undeflected position, solder posts 44 are secured in detents 162 in an interference fit. Furthermore, beams 122 and 124 remain in a deflected position as illustrated in FIG. 6. Loading block 84 is removed from cavity 32.

Channel 114 extends beyond detent 162 in extension 168 which is too narrow for entry of solder posts 44 and provides beams 122 and 124 with effective lengths greater than the depth of detent 162 during insertion of solder posts 44 in channels 114.

Solder posts 44 from the top row of contacts 38 are then secured in channel 112. A loading block 84 having channels 86 aligned with contact receiving passages 36 in the top row is positioned in cavity 32. As contacts 38 are inserted, solder posts 44 engage tapered lead in surfaces 120. Beams 122 and 124 deflect laterally with an effective beam length 170. After passing between tapered lead in surfaces 120 and through first region 128 of channel 112, solder posts 44 seat in detents 130. Detents 130 are shaped like and secure solder posts 44 in the same way as detents 162. Loading block 84 is removed form cavity 32 as insertion of contacts 38 is complete.

In this manner, all contacts 38 in a row of contact receiving passages 36 are inserted simultaneously, concurrent therewith, solder posts 44 thereof are inserted in profiled channels 112, 114 of a post spacer plate 46. As the solder posts 44 are inserted into channels 112, 114 the portion of post spacer plate 46 between adjacent channels deflects laterally with a different effective beam length for each row of contacts inserted.

With contacts 38 seated in detents 148, 162 and 130 in post spacer plate 46, the position of solder posts 44 in the plane of post spacer plate 46 is maintained. The position of contacts 38 in detents 148, 162 and 130 is achieved without plowing through or displacing any plastic in post spacer plate 46.

I claim:

1. An electrical connector assembly, comprising:

a dielectric housing defining a mating face and a mounting face, said housing having a plurality of terminal receiving passages extending from the mating face, a locator plate terminating in a rear face, said locator plate having first and second profiled channels opening onto said rear face and having an end remote therefrom, said locator plate between said first and second channels defining a deflectable beam having an effective beam length, a first channel comprising a region having a width narrower than a solder post adapted to be inserted therein, a detent adjacent said region in the direction of insertion of a solder post, said detent adapted to receive a solder post from said region, a second channel comprising, in the direction of insertion of a solder post: a first region having a width narrower than a solder post adapted to be inserted therein; a transition region adjacent said first region, said transition region widening in the direction of insertion of a solder post to substantially the width of a solder post proximate the end of said first channel; a second region adjacent the transition region, said second region substantially the width of a solder post; a restrictive neck adjacent the second region; and a detent at the end thereof, said detent adapted to receive and secure a solder post therein, whereby when a solder post is inserted into said region of said first channel said beam deflects toward said second channel and when a solder post is inserted into said first region of said second channel said beam deflects toward said first channel and as the solder post passes through the transition region the beam returns to an undeflected position with the beam remaining in an undeflected position as the solder post passes through the second region.

2. An electrical connector assembly as recited in claim 1 wherein the region of the first channel and the first region of the second channel are defined by substantially parallel channel walls.

3. An electrical connector assembly as recited in claim 1 wherein the first channel extends beyond the detent therein having a width narrower than a solder post adapted to be inserted into said first channel.

4. An electrical connector assembly as recited in claim 1 wherein said first channel and said second channel further comprise tapered lead-in surfaces from said rear face.

5. An electrical connector assembly as recited in claim 1 wherein said first channel comprises a further detent.

6. An electrical connector assembly as recited in claim 1 wherein said second channel comprises a further detent.

7. An electrical connector assembly as recited in claim 1 wherein the locator plate is an integral part of the housing.

8. An electrical connector assembly as recited in claim 1 wherein the mounting face is perpendicular to the mating face.

9. An electrical connector assembly as recited in claim 1 wherein the number of detents along a profiled channel corresponds to the number of terminal receiving passages laterally aligned therewith.

10. An electrical connector assembly as recited in claim 1 wherein the detents form rows along the locator plate.

11. An electrical connector assembly as recited in claim 1 wherein the channels are laterally aligned with one or more terminal receiving passages.

12. An electrical connector assembly, comprising:

a dielectric housing defining a mating face and a mounting face, said housing having a plurality of terminal receiving passages extending from the mating face, a locator plate terminating in a rear face, said locator plate having first and second profiled channels opening onto said rear face and having an end remote therefrom, said locator plate between said first and second channels defining a deflectable beam having an effective beam length, a first channel comprising a region having a width narrower than a solder post adapted to be inserted therein, a detent adjacent said region in the direction of insertion of a solder post, said detent adapted to receive a solder post from said region, a second channel comprising, in the direction of insertion of a solder post: a first region having a width narrower than a solder post adapted to be inserted therein; a transition region adjacent said first region, said transition region widening in the direction of insertion of a solder post to substantially the width of a solder post proximate the end of said first channel; a second region adjacent the transition region, said second region substantially the width of a solder post; a restrictive neck adjacent the second region; and a detent at the end thereof, said detent adapted to receive and secure a solder post therein;

a plurality of electrical terminals mounted in the housing, each terminal having a mating portion extending into a terminal receiving passage and a mounting portion extending proximate the mounting face, the mounting portion of each terminal secured in a detent in a channel, whereby when a solder post is inserted into said region of said first channel said beam deflects toward said second channel and when a solder post is inserted into said first region of said second channel said beam deflects toward said first channel and as the solder post passes through the transition region the beam returns to an undeflected position with the beam remaining in an undeflected position as the solder post passes through the second region.

13. An electrical connector assembly as recited in claim 12, wherein the mounting portion of the terminal is a solder tail.

14. An electrical connector assembly as recited in claim 12 wherein the mounting portion of each terminal is secured in a detent in a channel in an interference fit.

15. An electrical connector assembly as recited in claim 12 wherein the mounting portion of each terminal is secured in a detent in a channel that is laterally aligned with the terminal receiving passage into which the respective mating portion extends.

16. An electrical connector assembly as recited in claim 12 wherein the first channel extends beyond the detent therein having a width narrower than a solder post adapted to be inserted into said first channel.

17. An electrical connector assembly as recited in claim 12 wherein said first channel and said second channel further comprise tapered lead-in surfaces from said rear face.

18. An electrical connector assembly as recited in claim 12 wherein the locator plate is an integral part of the housing.

19. An electrical connector assembly as recited in claim 12 wherein the number of detents along a profiled channel corresponds to the number of terminal receiving passages laterally aligned therewith.

20. An electrical connector assembly as recited in claim 12 wherein the channels are laterally aligned with one or more terminal receiving passages.

21. An electrical connector assembly, comprising:

a dielectric housing defining a mating face and a mounting face, said housing having a plurality of terminal receiving passages extending from the mating face, a locator plate terminating in a rear face, said locator plate having a plurality of profiled channels opening onto said rear face and having an end remote therefrom, said locator plate between adjacent channels defining a deflectable beam, one of said plurality of profiled channels comprising, in the direction of insertion of a solder post: a first region having a width narrower than a solder post adapted to be inserted therein; a transition region adjacent said first region, said transition region widening in the direction of insertion of a solder post to substantially the width of a solder post proximate the end of an adjacent channel; a second region adjacent the transition region, said second region substantially the width of a solder post; a restrictive neck adjacent the second region; and a detent at the end thereof, said detent adapted to receive and secure a solder post therein.

* * * * *